US007459647B2

(12) United States Patent
Liu

(10) Patent No.: US 7,459,647 B2
(45) Date of Patent: Dec. 2, 2008

(54) ELECTRICAL SWITCH

(75) Inventor: Meng-Tzung Liu, Taichung Hsien (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 0 days.

(21) Appl. No.: 11/803,054

(22) Filed: May 10, 2007

(65) Prior Publication Data

US 2008/0099316 A1 May 1, 2008

(30) Foreign Application Priority Data

Oct. 30, 2006 (TW) ..... 95140019 A

(51) Int. Cl.
*H01H 15/00* (2006.01)

(52) U.S. Cl. ..... 200/16 R; 200/16 D

(58) Field of Classification Search ... 200/16 R–16 DA, 200/6 R, 6 B, 6 BA, 6 BB, 6 C, 553, 520, 200/530–533, 561–563, 293, 559
See application file for complete search history.

(56) References Cited

U.S. PATENT DOCUMENTS 3,729,600 A * 4/1973 Solomon et al. ..... 200/16 D
3,878,344 A * 4/1975 Lockard ..... 200/6 B
3,978,298 A * 8/1976 Fukuda et al. ..... 200/6 R
4,092,504 A * 5/1978 Kotaka ..... 200/16 D
4,319,102 A * 3/1982 Van Cleave et al. ..... 200/46
4,392,031 A * 7/1983 Curtis, III ..... 200/16 R
4,644,110 A * 2/1987 Watanabe et al. ..... 200/5 R
6,204,458 B1 * 3/2001 Chen et al. ..... 200/284
6,580,045 B1 * 6/2003 Kuo ..... 200/559
7,030,325 B2 * 4/2006 Blossfeld et al. ..... 200/11 R
7,078,641 B2 * 7/2006 Stack et al. ..... 200/553

* cited by examiner

*Primary Examiner*—Michael A Friedhofer
(74) *Attorney, Agent, or Firm*—Townsend and Townsend and Crew, LLP

(57) ABSTRACT

An electrical switch includes a dielectric casing, first and second terminal units, and an actuating unit. The dielectric casing includes a cover and a, mounting seat. The mounting seat is disposed in and attached to the cover. each of front and rear ends of the mounting seat is formed with a notch. Each of the first and second terminal units extends into the cover through the notch in a respective one of the front and rear ends of the mounting seat. The actuating unit extends into and is coupled to the cover, and is operable so as to selectively connect and disconnect the first terminal unit to and from the second terminal unit.

6 Claims, 7 Drawing Sheets

ELECTRICAL SWITCH

CROSS-REFERENCE TO RELATED APPLICATION

This application claims priority of Taiwanese application no. 095140019, filed on Oct. 30, 2006.

BACKGROUND OF THE INVENTION

1. Field of the Invention

This invention relates to an electrical switch, more particularly to an electrical switch that is relatively easy to manufacture.

2. Description of the Related Art

FIG. 1 illustrates an electrical switch 1, such as a micro-switch, that includes a dielectric casing 12, first and second terminal units 111, 112, a slidable unit 113, and an actuating unit 13.

The dielectric casing 12 includes a cover 122 that defines an accommodating space 120 and that has an open end, and a mounting seat 121 that is attached to the open end of the cover 122. Each of the first and second terminal units 111, 112 has a first end portion 118, 119 that is disposed externally of the dielectric casing 12, and a second end portion 114, 115 that extends into the accommodating space 120 in the cover 122. The slidable unit 113 is disposed slidably in the accommodating space 120 in the cover 122, and includes a conductive member 116 that is in electrical contact with the second end portion 114 of the first terminal unit 111. The slidable unit 113 is slidable relative to the dielectric casing 12 between a connecting position, where the conductive member 116 is connected to the second end portion 115 of the second terminal unit 112, as best shown in FIG. 1, thereby making an electrical connection between the first and second terminal units 111, 112, and a disconnecting position, where the conductive member 116 is disconnected from the second end portion 115 of the second terminal unit 112, as best shown in FIG. 2, thereby breaking the electrical connection between the first and second terminal units 111, 112. The actuator unit 13 extends into the accommodating space 120 in the cover 122, is coupled pivotably to the cover 122, and is operable so as to move the slidable unit 113 between the connecting and disconnecting positions.

Although the aforementioned conventional electrical switch 1 achieves its intended purpose, the first and second terminal units 111, 112 are mounted on the mounting seat 121 by molding the mounting seat 121 over the first and second terminal units 111, 112, which is relatively difficult to perform particularly for the electrical switch with 1.27 millimeters pitch or less. This results in a relatively low production yield due to defective products, thus increasing manufacturing costs.

SUMMARY OF THE INVENTION

Therefore, the object of the present invention is to provide an electrical switch that can overcome the aforesaid drawback of the prior art.

According to the present invention, an electrical switch comprises a dielectric casing, first and second terminal units, and an actuating unit. The dielectric casing includes a cover and a mounting seat. The cover includes opposite front and rear walls, which cooperatively define an accommodating space therebetween. The mounting seat includes a base wall, which is disposed in the accommodating space and which has opposite front and rear ends. Each of the front and rear ends of the base wall of the mounting seat is attached to a respective one of the front and rear walls of the cover, and is formed with a plurality of notches, each of which is in spatial communication with the accommodating space in the cover. The first terminal unit includes a plurality of conductive terminals, each of which extends into the accommodating space through a respective one of the notches in the front end of the mounting seat. The second terminal unit includes a plurality of conductive terminals, each of which extends into the accommodating space through a respective one of the notches in the rear end of the mounting seat. The actuating unit includes a plurality of actuators, each of which extends into the accommodating space and is coupled to the cover. Each of the actuators is operable so as to selectively connect and disconnect a respective one of the conductive terminals of the first terminal unit to and from a respective one of the conductive terminals of the second terminal unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 3:
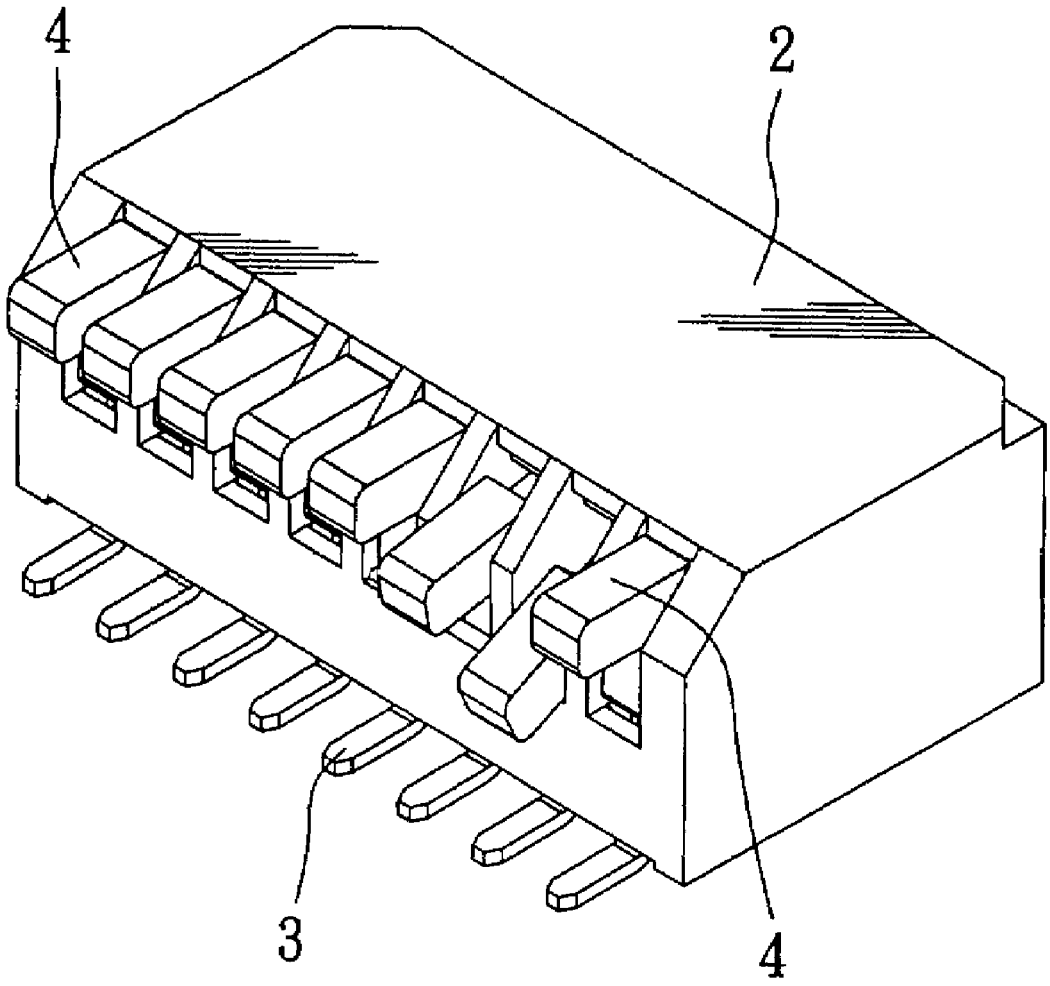
FIG. 3 is a perspective view of the preferred embodiment of an electrical switch according to this invention.
Figure 4:
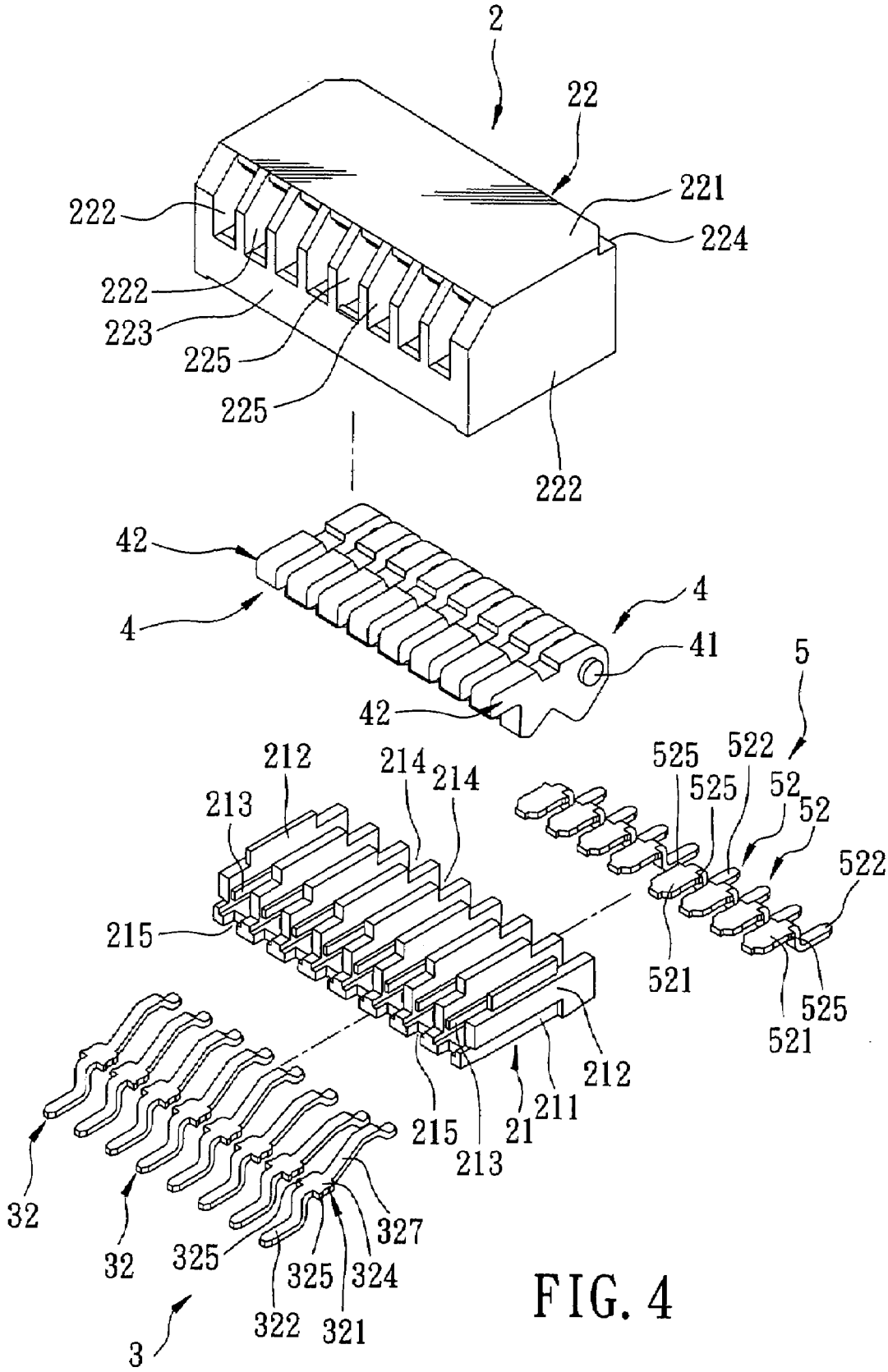
FIG. 4 is an exploded perspective view of the preferred embodiment.
Figure 5:
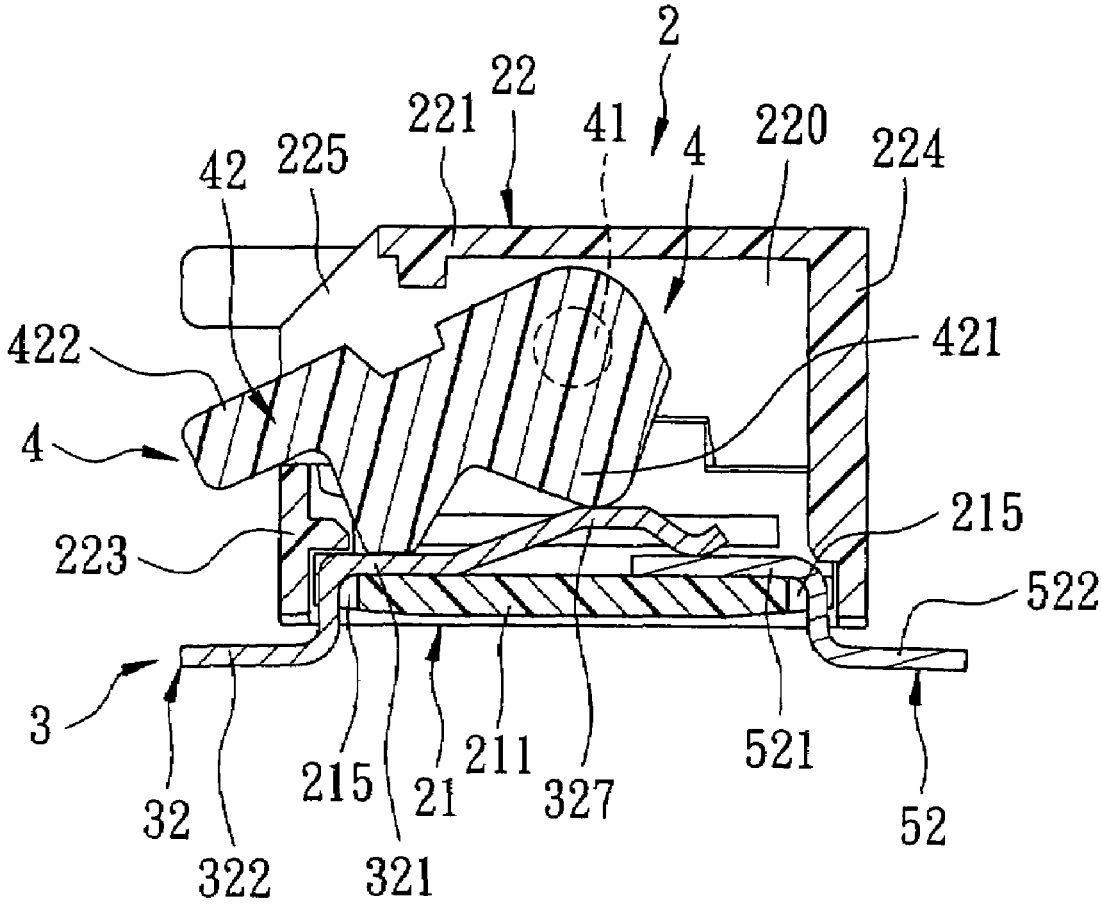
FIG. 5 is a sectional view to illustrate the preferred embodiment in an ON state.

Referring to FIGS. 3 to 5, the preferred embodiment of an electrical switch according to this invention is shown to include a dielectric casing 2, first and second terminal units 3, 5, and an actuating unit 4.

The electrical switch of this embodiment is a micro-switch that has a pitch of 1.27 millimeters.

The dielectric casing 2 includes a cover 22 and a mounting seat 21. The cover 22 of the dielectric casing 2 includes a base wall 221, opposite front and rear walls 223, 224, and nine dividing walls 222. The base wall 221 of the cover 22 is generally rectangular in shape. The front and rear walls 223, 224 of the cover 22 extend transversely and respectively from front and rear ends of the base wall 221 of the cover 22 and cooperate with the base wall 221 of the cover 22 to define an accommodating space 220. The dividing walls 222 of the cover 22 extend transversely from the base wall 221 of the cover 22, interconnect the front and rear walls 223, 224 of the cover 22, are disposed in the accommodating space 220 in the cover 22, and cooperatively define eight upper slots. The front wall 223 of the cover 22 is formed with eight through-holes 225, each of which is in spatial communication with a respective one of the upper slots in the cover 22.

The mounting seat 21 of the dielectric casing 2 is disposed in the accommodating space 220 in the cover 22, and includes a base wall 211, and nine dividing walls 212. The base wall 211 of the mounting seat 21 is generally rectangular in shape, and has opposite front and rear ends that are respectively attached, using an adhesive material, to the front and rear walls 223, 224 of the cover 22, and opposite left and right ends that are respectively attached, using the adhesive material, to the leftmost one and rightmost one of the dividing walls 222 of the cover 22. The dividing walls 212 of the mounting seat 21 extend transversely from the base wall 211 of the mounting seat 21 toward the base wall 221 of the cover 22, are disposed in the accommodating space 220 in the cover 22, and cooperatively define eight lower slots 214, each of which is in spatial communication with a respective one of the upper slots in the cover 22.

Each of the front and rear ends of the base wall 211 of the mounting seat 21 is formed with eight notches 215, each of which is in spatial communications with a respective one of the lower slots 214 in the mounting seat 21.

Figure 6:
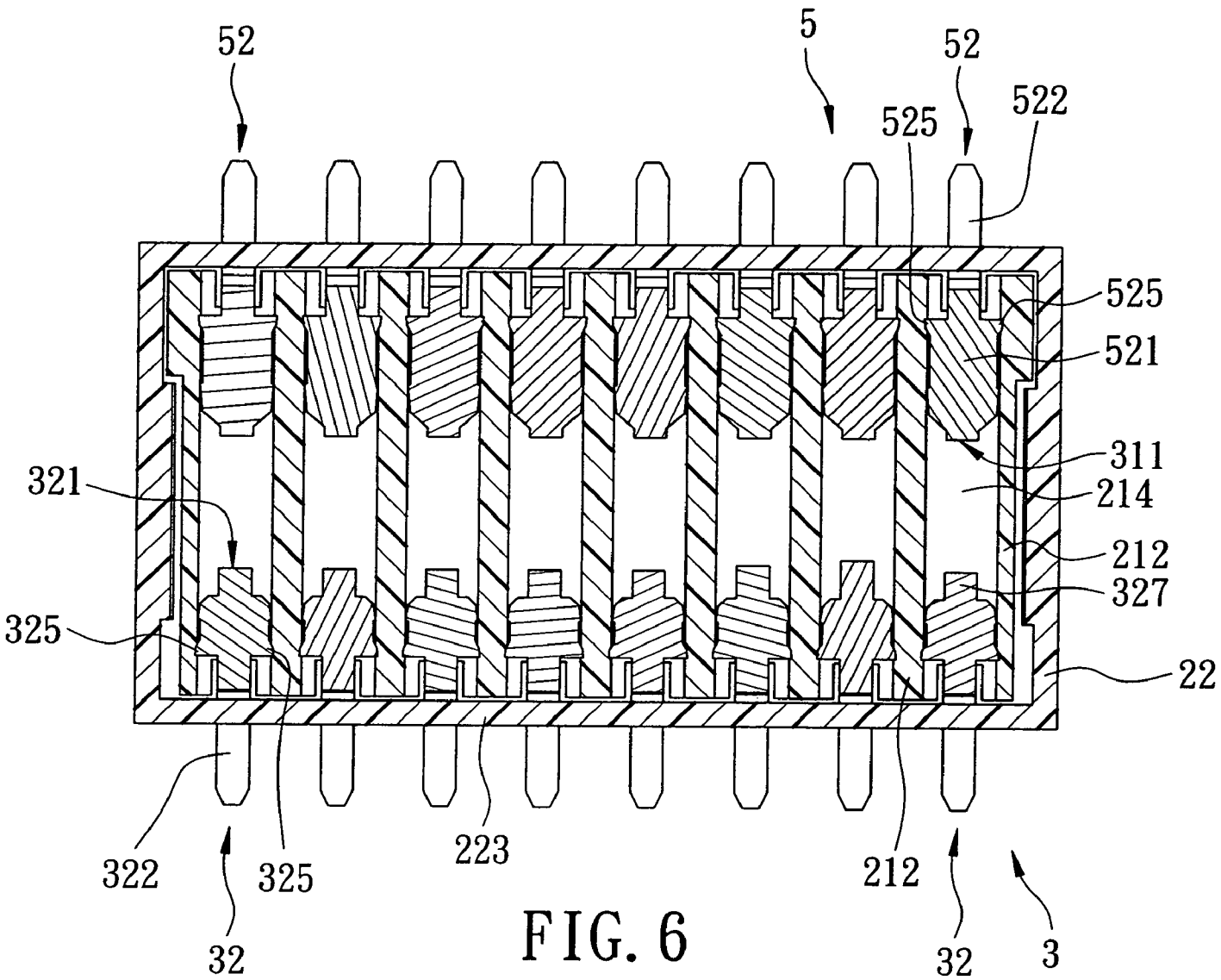
FIG. 6 is a sectional view illustrating first and second terminal units of the preferred embodiment.

With further reference to FIG. 6, the first terminal unit 3 includes a plurality of conductive terminals 32. In this embodiment, each of the conductive terminals 32 of the first terminal unit 3 has a first end portion 322 that is disposed externally of the dielectric casing 2, and a second end portion 321 that extends movably into a respective one of the lower slots 214 in the mounting seat 21 through a respective one of the notches 215 in the front end of the base wall 211 of the mounting seat 21. As such, the second end portion 321 of each of the conductive terminals 32 of the first terminal unit 3 is squeezed tightly between the front end of the base wall 211 of the mounting seat 21 and the front wall 223 of the cover 22.

In this embodiment, the second end portion 321 of each of the conductive terminals 32 of the first terminal unit 3 has secured and curved sections 324, 327.

The secured section 324 of the second end portion 321 of each of the conductive terminals 32 of the first terminal unit 3 has a width that corresponds to that of the respective one of the lower slots 214 in the mounting seat 21, and is provided with a pair of projections 325, each of which engages a respective one of an adjacent pair of the dividing walls 212 of the mounting seat 21, thereby securing the secured section 324 of the second end portion 321 of each of the conductive terminals 32 of the first terminal unit 3 in the respective one of the lower slots 214 in the mounting seat 21.

It is noted that the first end portion 322 of each of the conductive terminals 32 of the first terminal unit 3 has a width that is less than that of the secured section 324 of the second end portion 321 of a respective one of the conductive terminals 32 of the first terminal unit 3, and is spaced apart from the first end portion 322 of an adjacent one of the conductive terminals 32 of the first terminal unit 3 by a distance of 1.27 millimeters. In an alternative embodiment, the first end portion 322 of each of the conductive terminals 32 of the first terminal unit 3 is spaced apart from the first end portion 322 of an adjacent one of the conductive terminals 32 of the first terminal unit 3 by a distance of less than 1.27 millimeters.

The second terminal unit 5 includes a plurality of conductive terminals 52. In this embodiment, each of the conductive terminals 52 of the second terminal unit 5 has a first end portion 522 that is disposed externally of the dielectric casing 2, and a second end portion 521 that extends from the first end portion 522 of a respective one of the conductive terminals 52 of the second terminal unit 5 and into a respective one of the lower slots 214 in the mounting seat 21 through a respective one of the notches 215 in the rear end of the base wall 211 of the mounting seat 21. As such, the second end portion 521 of each of the conductive terminals 52 of the second terminal unit 5 is squeezed tightly between the rear end of the base wall 211 of the mounting seat 21 and the rear wall 224 of the cover 22.

The second end portion 521 of each of the conductive terminals 52 of the second terminal unit 5 has a width that corresponds to that of the respective one of the lower slots 214 in the mounting seat 21, and is provided with a pair of projections 525, each of which engages a respective one of the adjacent dividing walls 212 of the mounting seat 21, thereby securing the second end portion 521 of each of the conductive terminals 52 of the second terminal unit 5 in the respective one of the lower slots 214 in the mounting seat 21.

It is noted that the first end portion 522 of each of the conductive terminals 52 of the second terminal unit 5 has a width that is less than that of the second end portion 521 of a respective one of the conductive terminals 52 of the second terminal unit 5, and is spaced apart from the first end portion 522 of an adjacent one of the conductive terminals 52 of the second terminal unit 5 by a distance of 1.27 millimeters. In an alternative embodiment, the first end portion 522 of each of the conductive terminals 52 of the second terminal unit 5 is spaced apart from the first end portion 522 of an adjacent one of the conductive terminals 52 of the second terminal unit 5 by a distance of less than 1.27 millimeters.

Figure 1:
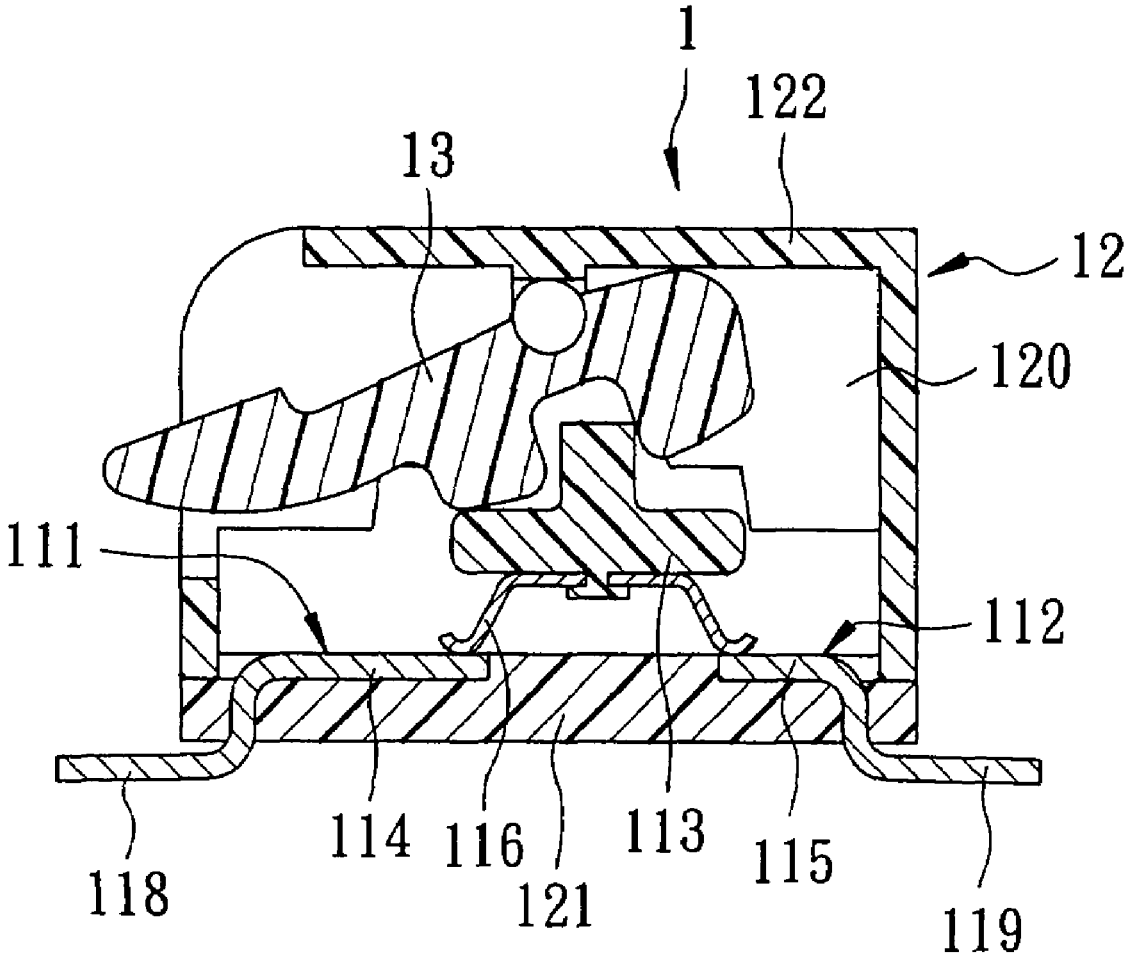
FIG. 1 PRIOR ART
FIG. 1 is a sectional view illustrating a conventional electrical switch in an ON state.
Figure 2:
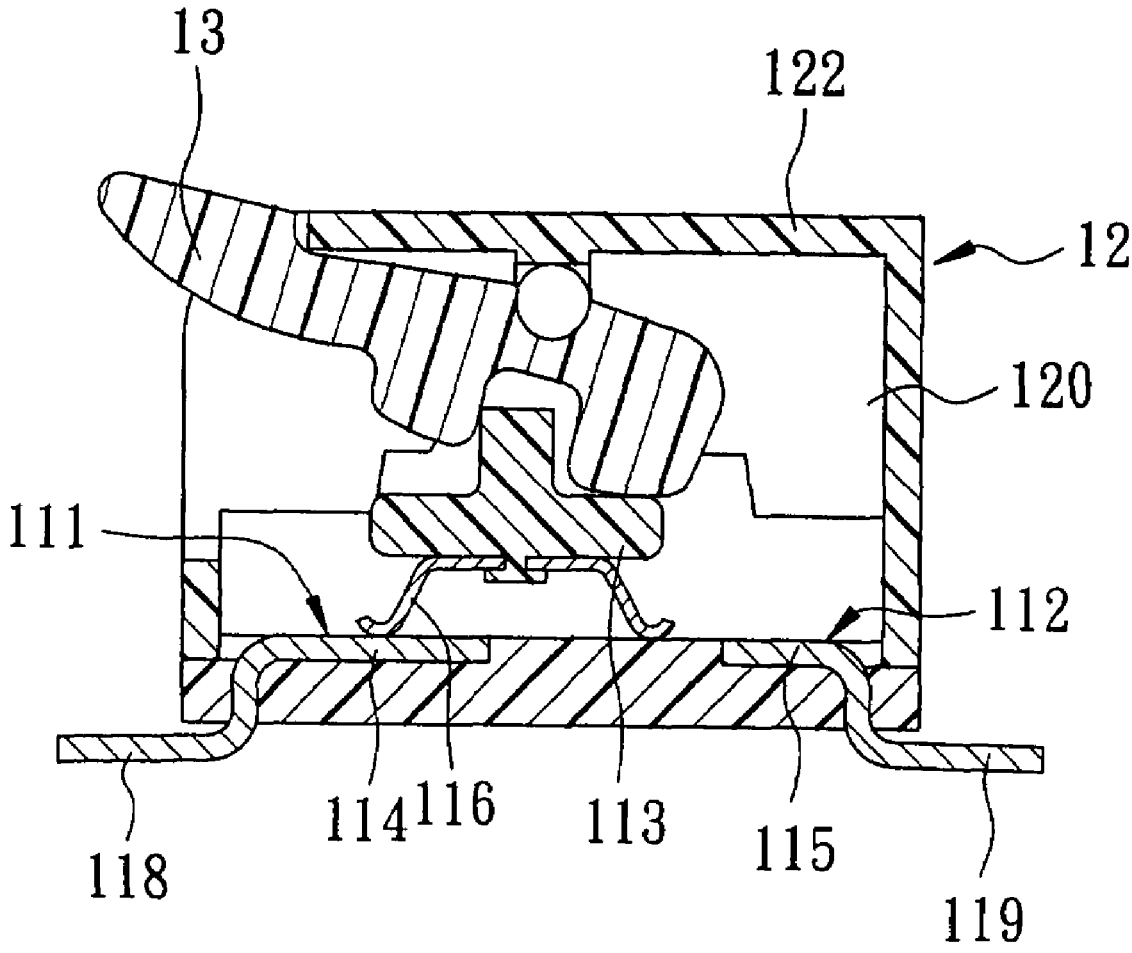
FIG. 2 PRIOR ART
FIG. 2 is a sectional view illustrating the conventional electrical switch in an OFF state.
Figure 7:
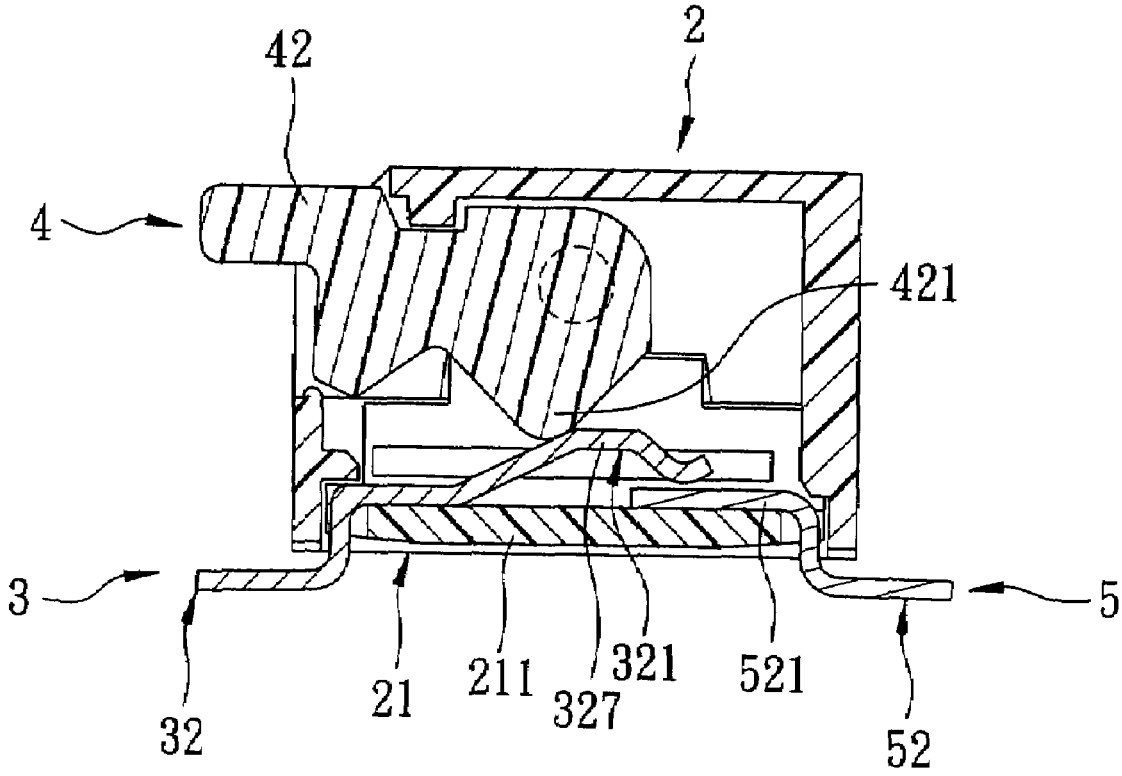
FIG. 7 is a sectional view to illustrate the preferred embodiment in an OFF state.

The curved section 327 of the second end portion 321 of each of the conductive terminals 32 of the first terminal unit 3 extends movably from the secured section 324 of the second end portion 321 of a respective one of the conductive terminals 32 of the first terminal unit 3, has a free end that is generally U-shaped, and is movable relative to the dielectric casing 2 between a connecting position, where the free end of the curved section 327 of the second end portion 321 of the conductive terminal 32 of the first terminal unit 3 is connected to the second end portion 521 of a respective one of the conductive terminals 52 of the second terminal unit 5, as best shown in FIG. 5, thereby making an electrical connection between the conductive terminal 32 of the first terminal unit 3 and the respective one of the conductive terminals 52 of the second terminal unit 5, and a disconnecting position, where the free end of the curved section 327 of the second end portion 321 of the conductive terminal 32 of the first terminal unit 3 is disconnected from the second end portion 521 of the respective one of the conductive terminals 52 of the second terminal unit 5, as best shown in FIG. 7, thereby breaking the electrical connection between the conductive terminal 32 of the first terminal unit 3 and the respective one of the conductive terminals 52 of the second terminal unit 5. The construction as such permits the electrical switch of this invention to be dispensed with the slidable unit 113 (see FIG. 1) of the conventional electrical switch 1 (see FIG. 1).

The electrical switch further includes eight retaining units, each of which prevents movement of the secured section 324 of the second end portion 321 of a respective one of the conductive terminals 32 of the first terminal unit 3 and the second end portion 521 of a respective one of the conductive terminals 52 of the second terminal unit 5 away from the base wall 211 of the mounting seat 21. In this embodiment, each of the retaining units is disposed in a respective one of the lower slots 214 in the mounting seat 21, and includes a pair of protrusions 213, each of which is provided on a respective one of an adjacent pair of the dividing walls 212 and abuts against the secured section 324 of the second end portion 321 of the respective one of the conductive terminals 32 of the first terminal unit 3 and the second end portion 521 of the respective one of the conductive terminals 52 of the second terminal unit 5.

The actuating unit 4 includes eight actuators 42. In this embodiment, each of the actuators 42 of the actuating unit 4 has a first end portion 422 that is disposed externally of the dielectric casing 2, and a second end portion 421 that extends into a respective one of the lower slots 214 in the mounting seat 21 through a respective one of the upper slots in the cover 22 and through a respective one of the through-holes 225 in the front wall 223 of the cover 22, that is coupled pivotably to an adjacent one of the dividing walls 222 of the cover 22 via a pivot joint 41, and that abuts against the curved section 327 of the second end portion 321 of a respective of the conductive terminals 32 of the first terminal unit 3.

Each of the actuators 42 of the actuating unit 4 is pivotable relative to the dielectric casing 2 between a first position, where the second end portion 421 of the actuator 42 is disposed proximate to the base wall 211 of the mounting seat 21 so as to dispose the curved section 327 of the second end portion 321 of the respective conductive terminal 32 of the first terminal unit 3 at the connecting position, as best shown in FIG. 5, and a second position, where the second end portion 421 of the actuators 42 is disposed distal from the base wall 211 of the mounting seat 21 so as to dispose the curved section 327 of the second end portion 321 of the respective conductive terminal 32 of the first terminal unit 3 at the disconnecting position, as best shown in FIG. 7.

It has thus been shown that the electrical switch of this invention includes a dielectric casing 2 that includes a cover 22 and a mounting seat 21, and first and second terminal units 3, 5, each of which includes conductive terminals 32, 52 that are squeezed tightly between the cover 22 and the mounting seat 21, thereby resulting in a structure that is relatively easy to manufacture and that is suitable for the electrical switch with 1.27 millimeters pitch or even less.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An electrical switch, comprising:

a dielectric casing including a cover that includes opposite front and rear walls, which cooperatively define an accommodating space therebetween, and a mounting seat that is disposed in said accommodating space in said cover, said mounting seat including a base wall that has opposite front and rear ends, each of which is attached to a respective one of said front and rear walls of said cover and is formed with a plurality of notches, and a plurality of dividing walls that cooperatively define a plurality of lower slots, each of which is in spatial communication with a respective one of said notches in said front end of said base wall of said mounting seat and a respective one of said notches in said rear end of said base wall of said mounting seat;

a first terminal unit including a plurality of conductive terminals, each of which extends into a respective one of said lower slots in said mounting seat through a respective one of said notches in said front end of said base wall of said mounting seat, each of said conductive terminals of said first terminal unit having a secured section that is provided with a pair of projections, each of which engages a respective one of an adjacent pair of said dividing walls of said mounting seat, and a curved section that extends from said secured section of a respective one of said conductive terminals of said first terminal unit and that is movable relative to said dielectric casing;

a second terminal unit including a plurality of conductive terminals, each of which extends into a respective one of said lower slots in said mounting seat through a respective one of said notches in said rear end of said base wall of said mounting seat;

an actuating unit including a plurality of actuators, each of which extends into said accommodating space and is coupled to said cover, each of said actuators being operable so as to selectively connect and disconnect said curved section of a respective one of said conductive terminals of said first terminal unit to and from a respective one of said conductive terminals of said second terminal unit; and a plurality of retaining units, each of which prevents movement of said secured section of a respective one of said conductive terminals of said first terminal unit away from said base wall of said mounting seat, each of which is disposed in a respective one of said lower slots in said mounting seat, and each of which includes a pair of protrusions that are respectively provided on an adjacent pair of said dividing walls of said mounting seat, wherein said secured section of each of said conductive terminals of said first terminal unit is disposed between said base wall of said mounting seat and a respective one of said retaining units.

2. The electrical switch as claimed in claim 1, wherein each of said conductive terminals of said first terminal unit has a first end portion that is disposed externally of said dielectric casing, and a second end portion that extends into a respective one of said lower slots in said mounting seat through a respective one of said notches in said front end of said base wall of said mounting seat, and that defines said secured and curved sections, said curved section of said second end portion of each of said conductive terminals of said first terminal unit being movable relative to said dielectric casing between a connecting position, where said curved section of said second end portion of said conductive terminal of said first terminal unit is connected to the respective one of said conductive terminals of said second terminal unit, and a disconnecting position, where said curved section of said second end portion of said conductive terminal of said first terminal unit is disconnected from the respective one of said conductive terminals of said second terminal unit, each of said actuators of said actuating unit being operable so as to move said curved section of said second end portion of the respective one of said conductive terminals of said first terminal unit between the connecting and disconnecting positions.

3. The electrical switch as claimed in claim 2, wherein said cover further includes a plurality of dividing walls disposed in said accommodating space and cooperatively defining a plurality of upper slots, said front wall of said cover being formed with a plurality of through-holes, each of said actuators of said actuating unit having a first end portion that is disposed externally of said dielectric casing, and a second end portion that extends into a respective one of said lower slots in said mounting seat through a respective one of said upper slots in said cover and a respective one of said through-holes, that is coupled pivotably to an adjacent one of said dividing walls of said cover, and that abuts against said curved section of said second end portion of the respective one of said conductive terminals of said first terminal unit, each of said actuators being pivotable relative to said dielectric casing between a first position, where said second end portion of said actuator is disposed proximate to said base wall of said mounting seat so as to dispose said curved section of said second end portion of the respective one of said conductive terminals of said first terminal unit at the connecting position, and a second position, where said second end portion of said actuator is disposed distal from said base wall of said mounting seat so as to dispose said curved section of said second end portion of the respective one of said conductive terminals of said first terminal unit at the disconnecting position.

4. The electrical switch as claimed in claim 1, wherein said curved section of each of said conductive terminals of said first terminal unit has a free end that is U-shaped.

5. The electrical switch as claimed in claim 1, wherein each of said conductive terminals of each of said first and second terminal units has an end portion that is disposed externally of said dielectric casing and that is bent, said end portion of each of said conductive terminals of said first terminal unit being spaced apart from said end portion of an adjacent one of said conductive terminals of said first terminal unit by a distance of at most 1.27 millimeters, said end portion of each of said conductive terminals of said second terminal unit being spaced apart from said end portion of an adjacent one of said conductive terminals of said second terminal unit by a distance of at most 1.27 millimeters, said end portion of each of said conductive terminals of said first and second terminal units being disposed substantially horizontally, thus being suitable for a surface mount attachment.

6. An electrical switch comprising:

a dielectric casing including a cover that includes opposite front and rear walls, which cooperatively define an accommodating space therebetween, and a mounting seat that is disposed in said accommodating space in said cover, said mounting seat including a base wall that has opposite front and rear ends, each of which is attached to a respective one of said front and rear walls of said cover and is formed with a plurality of notches, and a plurality of dividing walls that cooperatively define a plurality of lower slots, each of which is in spatial communication with a respective one of said notches in said front end of said base wall of said mounting seat and a respective one of said notches in said rear end of said base wall of said mounting seat;

a first terminal unit including a plurality of conductive terminals, each of which extends into a respective one of said lower slots in said mounting seat through a respective one of said notches in said front end of said base wall of said mounting seat;

a second terminal unit including a plurality of conductive terminals, each of which extends into a respective one of said lower slots in said mounting seat through a respective one of said notches in said rear end of said base wall of said mounting seat, and each of which is provided with a pair of projections that respectively engage an adjacent pair of said dividing walls of said mounting seat;

an actuating unit including a plurality of actuators, each of which extends into said accommodating space and is coupled to said cover, each of said actuators being operable so as to selectively connect and disconnect a respective one of said conductive terminals of said first terminal unit to and from a respective one of said conductive terminals of said second terminal unit; and a plurality of retaining units, each of which prevents movement of a respective one of said conductive terminals of said second terminal unit away from said base wall of said mounting seat, each of which is disposed in a respective one of said lower slots in said mounting seat, and each of which includes a pair of protrusions that are respectively provided on an adjacent pair of said dividing walls of said mounting seat, wherein each of said conductive terminals of said second terminal unit is disposed between said base wall of said mounting seat and a respective one of said retaining units.

* * * * *